United States Patent [19]

Adler

[11] 4,020,891

[45] May 3, 1977

[54] MELT SPINNING PROCESS AND MACHINE

[75] Inventor: Ralph P. I. Adler, Glencoe, Ill.

[73] Assignee: Brunswick Corporation, Skokie, Ill.

[22] Filed: Nov. 11, 1974

[21] Appl. No.: 522,507

[52] U.S. Cl. ..... 164/82; 164/124; 164/273 R; 164/28 R; 164/283 S

[51] Int. Cl.[2] ..... B22D 11/124

[58] Field of Search ..... 164/82, 259, 273 R, 164/281, 283 R, 283 S, 124; 425/72

[56] References Cited

UNITED STATES PATENTS

| | | | |
|---|---|---|---|
| 2,976,590 | 3/1961 | Ford | 164/82 |
| 3,347,959 | 10/1967 | Engelke et al. | 164/82 X |
| 3,602,291 | 8/1971 | Ford | 164/82 X |
| 3,645,657 | 2/1972 | Otstot et al. | 164/66 X |
| 3,715,419 | 2/1973 | Prwott, Jr. et al. | 164/82 X |
| 3,720,741 | 3/1973 | Cunningham et al. | 164/82 X |
| 3,854,518 | 12/1974 | Junker | 164/82 X |
| 3,854,519 | 12/1974 | Junker | 164/82 X |

*Primary Examiner*—Ronald J. Shore
*Attorney, Agent, or Firm*—John G. Heimovics

[57] ABSTRACT

This invention sets forth an improved method of continuously casting a metal filament or fiber from molten liquid metal. The filament is formed by forcing the molten metal from a melt pot through an orifice and solidifying the molten metal jet into a filament while it is moving in a cooling atmosphere. As the solid filament moves with respect to the gas atmosphere, the gas by friction with the surface of the filament will exert a force on the filament, either acceleration or deceleration depending on whether the gas is flowing with a velocity greater or less than the filament velocity. The invention sets forth parameters defining the relations that must exist between the filament velocity and cooling gas velocity which give rise to acceleration and deceleration forces and whose magnitudes determine the formation of continuous filament or fibers.

3 Claims, 15 Drawing Figures

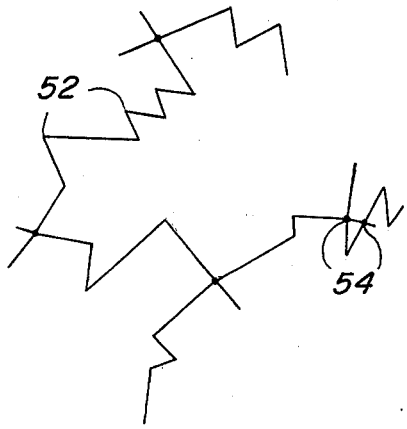
FIG. 5
FIG. 6
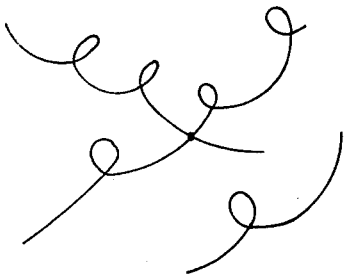
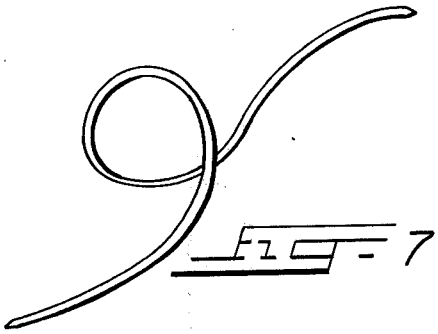
FIG. 7
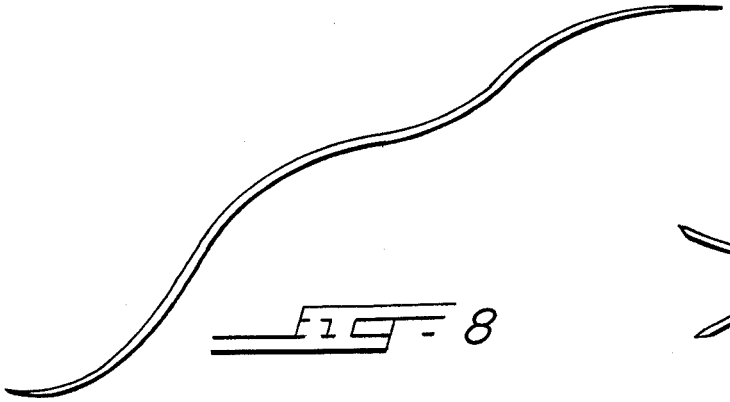
FIG. 8
FIG. 9
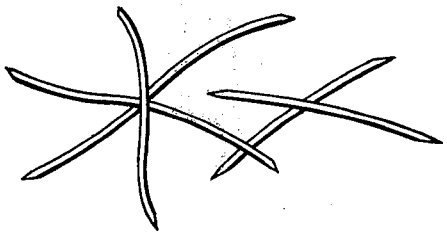

MELT SPINNING PROCESS AND MACHINE

BROAD SUMMARY OF THE INVENTION

The present invention is directed to an improved method of making metal filaments or fibers by injecting molten metal jet or jets into a coolant gas for solidification. The process involves using a melt pot containing a molten liquid preferably under pressure, and forcing the molten metal through an orifice in the melt pot with a certain exit velocity which primarily depends on the differential in pressure between that inside the pot and that existing outside the pot. The molten jet flows from the orifice into a cooling atmosphere which can be stagnant, flowing in the direction of the jet flow (co-current flow) or flowing opposite to the direction of the jet flow (counter current flow). The jet stream interacts with the cooling atmosphere and this interaction consists of both thermal and mechanical reactions. The thermal reactions being the means by which the molten stream solidifies and the mechanical reactions involving the relative motion of the filament and the filament forming stream with the cooling atmosphere.

As the molten jet flows from the melt pot orifice it will for a short distance remain in the liquid state, this region referred to as the molten zone. The portion of the molten jet that exits the orifice and remains in a liquid state (being in the molten zone) is referred to herein as the jet, the molten jet, the molten stream or the jet stream (these terms being used interchangeably). Once the jet stream starts to solidify and after it is fully solidified it is referred to as a filament or fiber. As used herein the total product from beginning to end of the initial molten jet stream, the intermediate semi-solidified stream and the finally formed filament or fiber is referred to as the "filament stream". Upon proceeding into the gas atmosphere the gas by friction with the surface of the filament stream will exert a force on the filament stream, either acceleration or deceleration depending on whether the gas is flowing with a velocity greater or less than the jet velocity. If sufficient deceleration forces are encountered by the filament stream, they will cause mechanical disruptions that travel upward along the filament stream and cause it to break at a weaker zone forming discontinuous fibers. If sufficient acceleration forces are encountered by the filament stream, tensile forces will be exerted on the filament stream pulling it away from the molten zone and again forming fibers.

The interrelationship between the thermal and mechanical reactions is very complex. It involves the stabilizing of the molten liquid jet stream by the rapid formation of an annular outer shell on the molten jet stream before surface tension or mechanical forces can cause jet stream breakup. It involves the forces generated by the degree of mismatch (or relative velocity) between the metal filament stream velocity and the velocity of the cooling gas. It also involves the possible propagation of disturbing mechanical disruptions traveling up the filament stream, in the art referred to as drag sustained deviations. And it involves the acceleration force on the filament stream when the cooling gas flowing in the same direction as the filament has a greater velocity. This acceleration force in the art is usually referred to as the acceleration drag. All these factors, which in turn are influenced by the physical and chemical properties of the jet and gas phases, interact during metal filament stream flow and solidification and the degree to which each one exerts its influence will determine whether continuous filaments or fibers are made.

SUMMARY OF THE PRIOR ART

The prior art discusses the problems of the thermal and mechanical reactions of the filament stream flowing into the cooling atmosphere and solutions to specific problems are given in processes for melt spinning of liquid metal and other low viscosity inorganic materials with a number of patents being issued on these processes. Recent developments are really improvements of the early basic ideas.

One of the earliest patents is U.S. Pat. No. 262,625 directed to the extrusion of molten metal through orifices into a tank of liquid coolant to make wire solder. This was one of the earliest attempts to convert molten metal directly into a filament, wire or thin strip. Different approaches were later taken wherein molten metal was cast into grooves in a wheel from which the metal is later stripped after solidification (U.S. Pat. No. 359,348), or rotating a wheel at considerable speed with the solidifying filament cast into the air by centrifugal force. (U.S. Pat. Nos. 745,786 and 989,075). These methods were directed at rapid solidification using solid or liquid molds that act as heat sinks.

In 1947 A. C. Merrington and E. G. Richardson disclosed in an article, "the Break-up of Liquid Jets", Vol. 59, Part 1, The Proceedings of the Physical Society, the physical properties that affect continuity in a liquid jet stream. The article focused on the problem of liquid jet break-up of relatively high viscosity and low surface tension fluids, by the action of mechanical disturbances. The article made only one reference to molten metal (i.e. Mercury) jet streams but did establish that a direct relationship exists between the stable length annd viscosity of the liquid jet stream. They also suggested that the stable length of a jet would be increased if the jet is injected into a co-currently moving air stream due to a reduction in air resistance.

A number of years subsequent to these patents another article appeared in Poroshkovaya Metallurgiya, No. 10 (82), PP. 44–51, October, 1969. This paper considered in more detail the production of metal fibers and filaments by melt extrusion with emphasis on determining the position of the solidified section on the jet trajectory defined by a relationship involving the exit velocity and the angle from the vertical with which the jet stream emerged from the melt pot orifice. It disclosed that increasing the exit velocity of the jet stream is accompanied by a sharp supercooling of the melt and rupture of the solidified strand by mechanical vibrations traveling to the upper part of the strand.

Of the number of U.S. Patents issued subsequent to all that work and which are particularly relevant to the instant invention, the inventor cites U.S. Pat. Nos. Re 27,123; 3,720,741; 3,216,076; 3,715,419; and 3,602,291. These patents describe methods of maintaining jet integrity by varying the cooling atmosphere conditions to form a stabilized film on the surface of the molten metal jet or minimizing mechanical disturbances. The most pertinent patent the inventor believes to be U.S. Pat. No. 3,720,741 with reference to which the inventor will show the improvement which he has discovered.

From the articles and references cited above it is noted that although each considers specific aspects and physical parameters affecting filament length and diameter, none disclose the condition within which different length filaments and fibers can be made by regulating the velocity of the coolant fluid with respect to the velocity of the liquid jet stream. None of the art suggests such regulation to control the deceleration or acceleration forces that influence the quality of the filament or fiber. This art does not suggest the interrelation that exists between these velocities that defines the ranges within which filament or fiber can be made. Nowhere does the art recognize this relationship. At best the art indirectly discloses a lower limit on filament continuity due to the deceleration drag forces that cause the propagation of drag sustained deviations.

As used herein to describe this invention, the term "filament" is defined as a melt spun product having an aspect ratio (length to diameter l/d) greater than 10,000:1 and the term "fiber" is defined as a melt spun product having an aspect ratio of less than 10,000:1.

SUMMARY OF THE INVENTION

This invention relates to a method of making metal filaments or fibers and more particularly, an improved method of making metal filaments or fibers from a molten metal filament stream.

According to this invention, it has been found that the most significant factor exerting control over filament stream continuity is the relative velocity between the coolant fluid and molten liquid jet. The method involves the formation of a jet by passing the molten metal charge through a melt pot orifice where the jet velocity can be appropriately controlled. The jet is injected into a column of coolant gas where appropriate ducting and pumping equipment are adjusted to control the gas flow conditions. For a short distance after exiting from the melt pot orifice the molten jet stream is still in a liquid state before solidifying. When the filament stream is moving faster than the coolant fluid, drag deceleration forces act on the solidifying filament stream inducing disruptive mechanical forces on the filament stream causing it to helically distort resulting in even greater drag disruptions and inducing drag sustained deviations (mechanical vibrations) which travel toward the orifice with a certain propagation velocity. These mechanical vibrations can increase vibrations can increase to the point where filament continuity is terminated. As the relative velocity of the liquid jet is decreased so that the difference between coolant and liquid jet velocities becomes smaller, a condition of dynamic equilibrium is reached where continuous filaments of selected lengths can be produced. Decreasing the relative liquid jet velocity further so that the coolant velocity exceeds the molten jet stream velocity, drag acceleration forces begin to act on the filament stream creating longitudinal tensile forces thereon which may increase to the point where actual tensile forces can be sufficiently great to periodically pull preselected lengths of filament away from the melt zone.

A primary object of this invention is to provide a method of making continuous metal filaments from a molten metal stream by preselectively controlling the molten jet velocity and cooling fluid velocity.

Another object of this invention is to provide a method of making metal fibers from a molten metal stream by preselectively controlling the molten jet velocity and the cooling fluid velocity.

Still another object of this invention is to provide improved filaments or fibers from such methods.

Additional objects and advantages of the invention will become apparent to those skilled in the art from the following discussion of the several examples and structures illustrated, which will be described in connection with the attached drawings, in which.

Figure 3A:
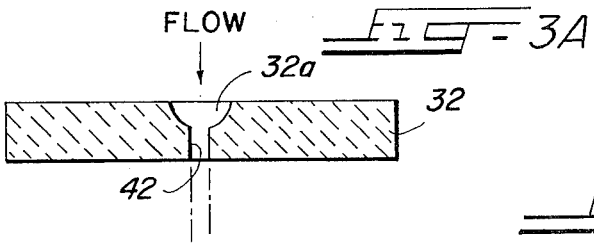

FIG. 3*a* is an enlarged cross-section of the preferred orifice for use in the present invention.

Figure 3B:
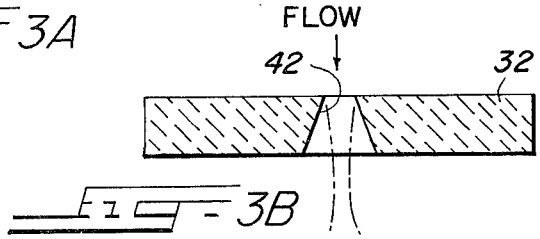

FIG. 3*b* is an enlarged cross-section of a second orifice for use in the present invention.

Figure 3C:
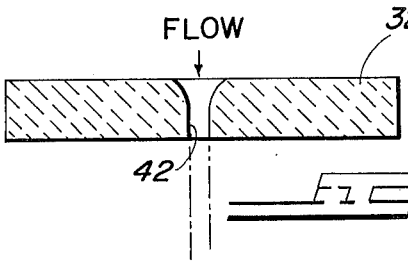

FIG. 3*c* is an enlarged cross-section of a third orifice for use in the present invention.

Figure 3D:
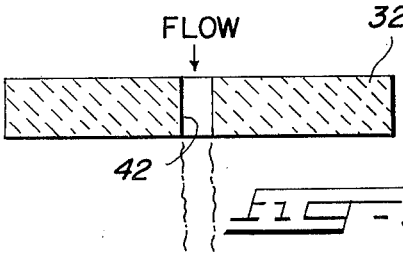

FIG. 3*d* is an enlarged cross-section of a fourth orifice for use in the present invention.

Figure 4:
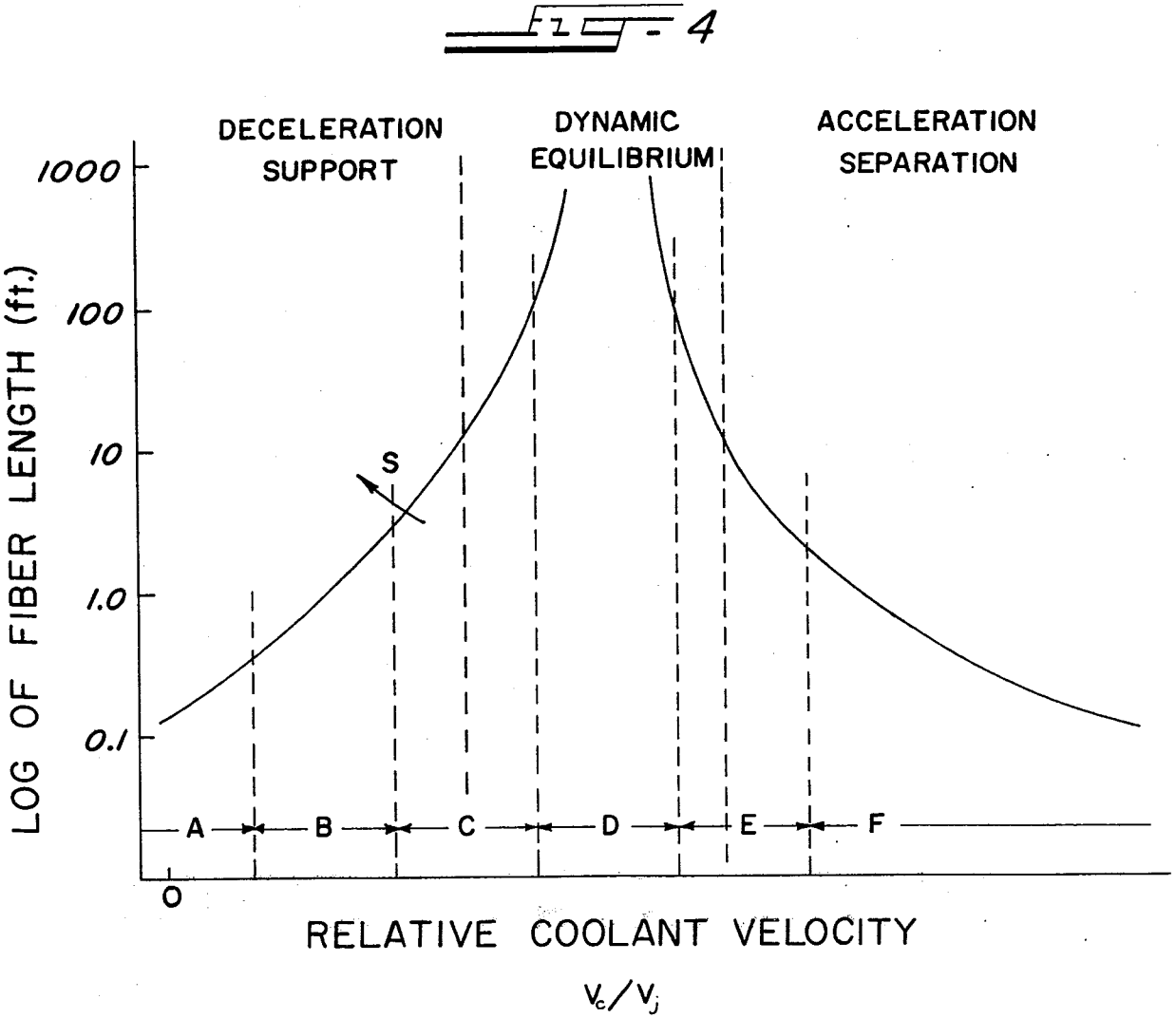

FIG. 4 is a graph indicating the coolant-jet interactions showing the change in fiber length with a change in the ratio of velocity of the coolant to the velocity of the molten stream.

FIG. 5 is a sketch showing the type of fiber produced when in zone A of FIG. 4.

FIG. 6 is a sketch showing the type of fiber produced when in zone B of FIG. 4.

FIG. 7 is a sketch showing the type of fiber produced when in zone C of FIG. 4.

FIG. 8 is a sketch showing the type of fiber produced when in zone D of FIG. 4.

FIG. 9 is a sketch showing the type of fiber produced when in zone E of FIG. 4.

Figure 10:
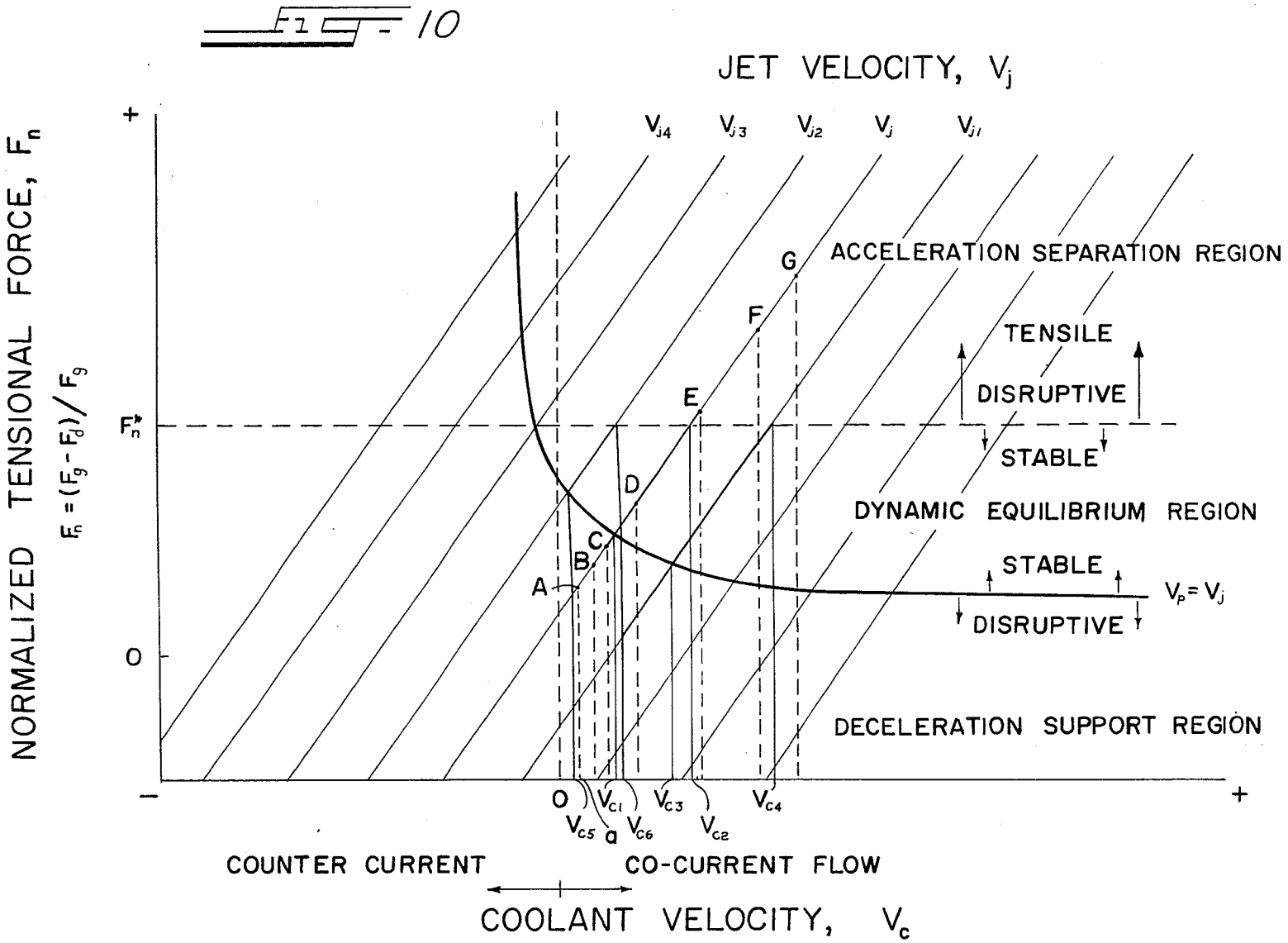

FIG. 10 is a graph of the normalized vertical stream force as function of coolant velocity for various molten stream velocities.

Figure 11:
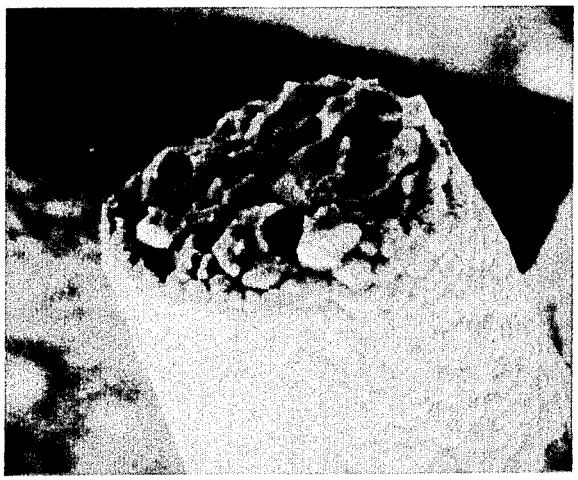

FIG. 11 is a photomicrograph of a 5 mil fiber showing a square break taken at 500 × magnification.

Figure 12:
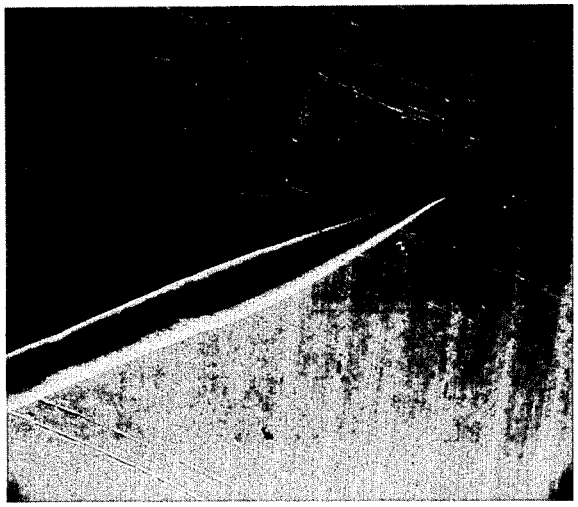

FIG. 12 is a photomicrograph of a 7 mil fiber showing a wet break taken at 50 × magnification.

DETAILED DESCRIPTION OF THE PREFERRED EMMBODIMENTS

In general terms the basic features of this invention establish that three velocities affect the length of the filament or fiber as hereinbefore defined. The three velocities comprise (1) velocity of the coolant $V_c$, (2) velocity of the molten metal stream $V_j$, and (3) propagation velocity of drag sustained deviations $V_p$.

Figure 1:
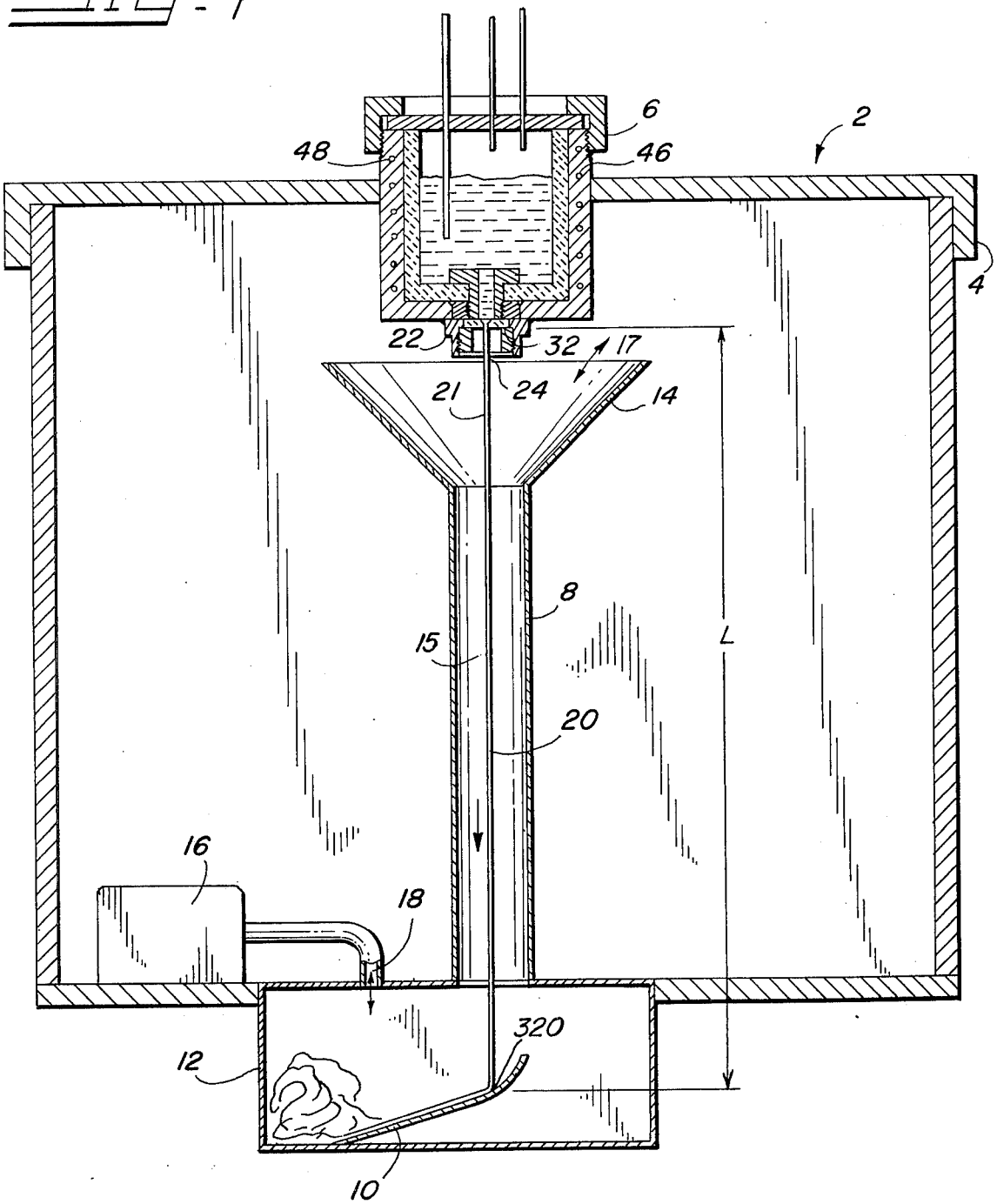
FIG. 1 is a vertical cross-section of the melt spinning apparatus used in the present invention.

In a preferred embodiment of the invention referring to FIG. 1, an apparatus is shown which may be used in the spinning of low viscosity molten metal jets, the apparatus shown in sectional vertical view for simplification. The apparatus 2 comprises a stand 4 upon which is mounted a melt pot 6, a coolant duct 8, a coolant atmosphere 15, deflecting plate 10, and accumulator chamber 12. At one end of the coolant duct 8 there is a flared entrance opening 14. In operative association with the accumulator 12 is a blower 16 connected by inlet-outlet port 18 to provide coolant flow at the base of the melt pot 6 as indicated by arrow 17. The coolant flow may be either co-current or counter-current with the filament stream 20 which emerges from orifice plate 32. The melt stream is essentially comprised of a molten region 24 extending a short distance from orifice plate 32 where the metal stream is still in a liquid state. In a somewhat continuous manner, the filament stream begins to form an outer annular stabilizing sheath of solid material. Below point 21 the bulk of the jet stream transforms to a solid along a nominally planar front that is perpendicular to the fiber axis. There is no evidence of a radially directed solidification pattern in the filament that is typically present in conventionally or continuously cast structures where heat is extracted through mold walls. Instead the filament or fiber according to this invention has axial-lydirected dendrite-type growth forms which indicate that both heat transfer and crystal growth directions are axial. Apparently the solidified filament stream below point 21 acts as a more efficient heat sink enabling more thermal energy to flow in an axial direction at the solidification front. Radial heat transfer to the cooling gas and equipment reducing to ambient temperature the lower portions of the filament stream takes place in the lower region of coolant duct 8.

Figure 2:
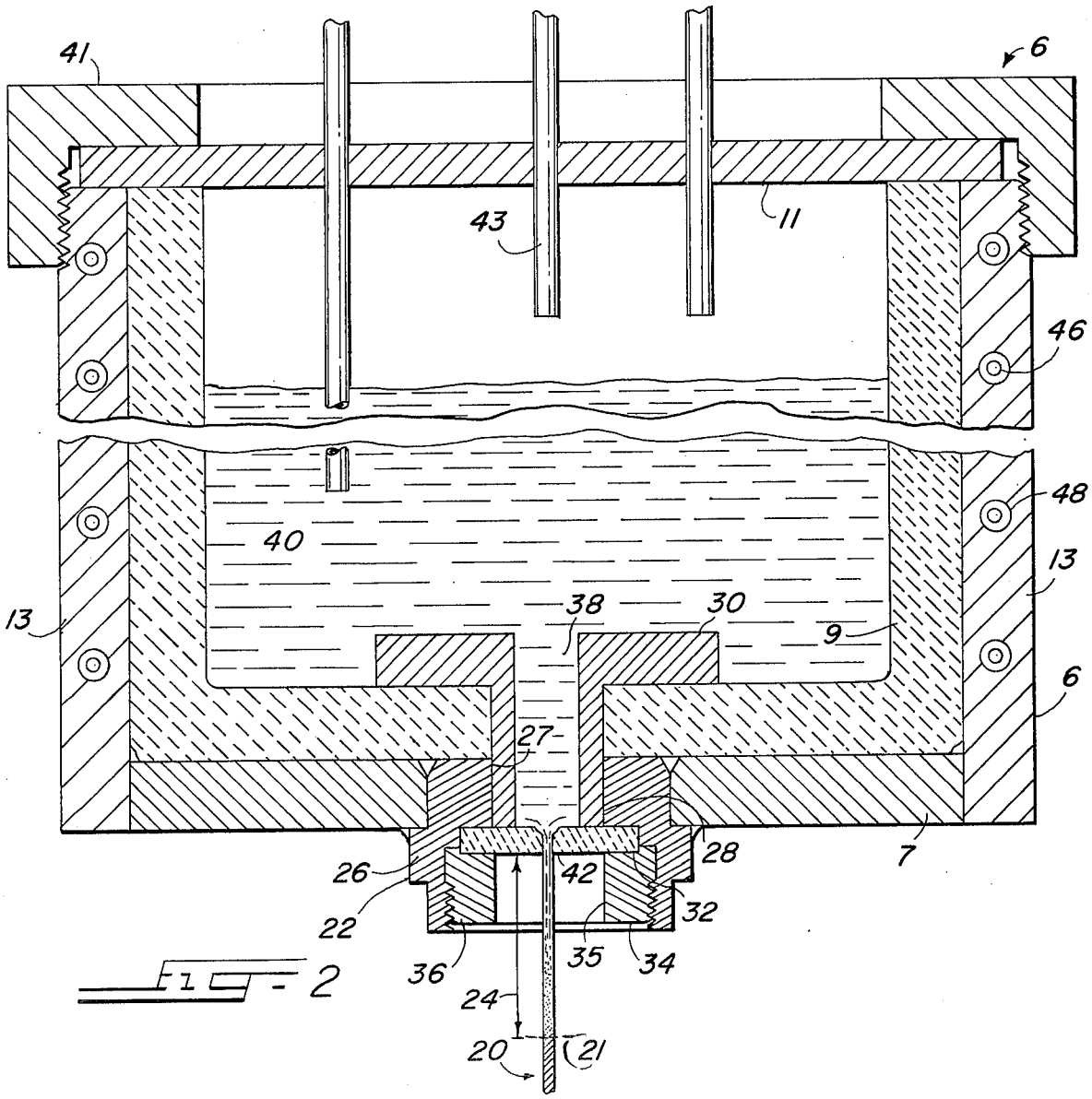
FIG. 2 is an enlarged cross-section of the melt pot and orifice structure.

FIG. 2 shows an enlarged section of one embodiment of the melt pot 6 with the orifice region comprised of a body section 26 having a central bore 28 with an erosion shield insert 30 positioned therein. The insert 30 butts against orifice plate 32 having a flow opening 42, with plate 32 held securely within body section 26 by a retainer nut 34 having a bore 35. The insert 30 is made to prevent erosion of opening 27 in liner 9. The body section 26 is secured to bottom plate 7 of melt pot 6 having a non-reactive liner 9. The melt pot or vessel 6 has a cylindrical sidewall 13 joined to bottom plate 7, and a top cover 11 which is secured to the top surface of sidewall 13 by a threaded retainer ring 41 to form a gas tight enclosure such that a pressurized inert gas flowing through port 43 can establish enough pneumatic pressure within melt pot 6 to force the molten melt 40 through flow opening 42. The molten melt flows from the container through passage 38 and orifice flow opening 42. The length of the molten region 24 varies with the thermal properties of the metal melt, exiting melt stream velocity $V_j$, diameter of the molten metal stream upon exiting orifice 42 and the thermal properties of the coolant atmosphere used.

To form metal filaments or fibers with melting points under 900° C, the melt pot 6, bottom plate 7, sidewall 13 cover plate 11, body section 26, and retainer nut 34 can be made of 304 stainless steel. However, more refractory construction materials are needed for higher melting point metals. Orifice plate 32 like insert 30 can be made of boron nitride or other non-reactive, thermal shock resistant materials.

Melt pot 6 can also contain a heating coil 46 in an insulating barrier 48 for keeping melt charge 40 at a desired melt temperature.

The orifice plate 32 is normally oriented for converging flow as shown in FIG. 3*a*, although flow opening 42 may take alternate shapes, three shown as examples in FIGS. 3*b*, 3*c* and 3*d*. The orifice plate 32 shown in FIG. 3*a* normally has a hemispherical depression 32*a* with the orifice 42 located at the base, the depression minimizing the length of the orifice passage to reduce frictional (pressure) losses from capillary flow while still retaining a sufficient orifice plate section to withstand overpressure needed to drive the liquid metal through the orifice. As an alternative, the depression shown may be conical in shape. The number of possible combinations of shapes and orientation for both orifice and the depression is virtually limitless and can be selected according to requirements. It was found that once continuous jet flow is established through the orifice, the fiber or filament diameter produced is independent of jet flow velocity, and this result is consistent with orifice flow theory.

Although only one flow opening 42 is shown it is noted that mass flow rate (product rate) is a function of the number of orifices used. The thermal and cooling requirements of spinning streams in a gaseous environment become more complex with the important parameter being orifice spacing between adjacent orifices. The same operating variables (molten jet velocity annd coolant velocity) that control fiber quality, quantity and continuity for spinning single streams can be applied to multiple stream spinning. Also for a given multiple orifice plate, random jet contact can be decreased by increasing the extrusion pressure and correlatively, the exiting jet velocity. Taking into consideration all of the factors controlling both fiber quality, quantity and continuity for spinning single filament stream, it was found these factors remain the same for multiple filament streams which therefore permits the use of single filament stream data to be easily extended to multi-jet extrusion orifices.

FIG. 4 depicts the change in the fiber length as a function of the ratio of velocity of the coolant $V_c$ to the velocity of the molten stream $V_j$. Both $V_c$ and $V_j$ defined as positive when the motion of either flow is perpendicular to and away from the orifice. This graph illustrates the two branch behavior of fiber length when the liquid metal is injected into a coolant gas at various relative velocities. Three distinct ranges can be readily defined. A deceleration support range where the velocity of a jet stream is generally much greater than the coolant velocity. Here drag deceleration (deceleration support) causes disruptive forces that produce filament termination, with the frequency of termination being proportional to the velocity difference between $V_c$ and $V_j$. A dynamic equilibrium range where the jet stream is adjusted relative to the coolant such that the net forces on the filament jet allow the formation of continuous filaments having aspect ratios (length to diameter) of typically 10,000 and greater. The third range is the acceleration separation range where the velocity of the jet stream is generally less than the coolant velocity. This is the range of co-current flow where the drag forces exerted by the coolant moving along the fiber surface in conjunction with the fiber weight can cause an increasing tension force on the fiber to periodically separate the solidified portion away from the molten region. Th total force at any point on the filament stream is proportional to the velocity mismatch between the coolant and jet stream and to the length between that point and the leading tip as long as the length L (see FIG. 1) has not been reached.

The type of curve shown in FIG. 4 is illustrative of the relationship between the fiber length and relative velocity $V_c$ and $V_j$, for a particular composition and diameter. Since the buildup of applied stresses determines the type and frequency of fiber discontinuities and these are a function of both the density of the metal and the surface area per unit volume, the single curve is a representation of but one of a family of curves that can be generated for other variations in metal fiber diameter and density. In a qualitative sense for melt spun fibers of a fixed composition (i.e. density) the entire curve can be envisioned to shift to the left (or to smaller $V_c/V_j$ values) as indicated by arrow S when melt spinning larger diameter metal fibers. Correlatively the curve in FIG. 4 will shift to the right when spinning smaller diameter fibers or filaments. Similarly, melt spinning a lower density fiber but keeping fiber diameter constant would produce a curve with an equivalent shift to the right (or to higher $V_c/V_j$ values), with an analogous shift of the curve to the left for melt spun material of higher density.

By way of example Aluminum fibers made in zones A through D of FIG. 4 shown in FIGS. 5 to 8 and zones E and F of FIG. 4 produce fibers as shown in FIG. 9 are indicative of the type of product resulting when the relative coolant and jet stream velocities fall within each zone. At a low coolant velocity (this includes stagnant and counter-current flow conditions) corresponding to conditions in zone A in FIG. 4 very short length fibers are produced. Fibers formed in stagnant coolant columns are vey kinky in nature (see FIG. 5) often exhibiting sharp bends or elbows as at points 52 and tending to have randomly fused cross-over point bonds as at points 54.

The kinky structure is due to the fact that the molten jet stream velocity is much greater than the coolant velocity. This difference in velocity causes the lower solidified portion of the jet stream to slow down to a velocity less than the upper portion of the jet stream and the resulting stresses cause the fragile fiber column to buckle or break. Once initial deformation occurs, this mechanical disturbance continues upstream to cause further deflection or fiber breakage. This type of breakage is referred to as a square break clearly depicted in FIG. 11 for a 7 mil diameter fiber.

The interfiber bonds as at points 54 result as the faster moving portion of the jet stream impinges on slower falling, previously formed kinky fiber sections which are drifting down the cooling column.

When the blower 16 is turned on to induce even small amounts of co-current coolant gas flow, fiber is produced as in zone B. FIG. 6, slightly longer than zone A fiber but having a generally helical shape. Further increasing the coolant velocity decreases the amount of helical pitch and defines the fiber shown in FIG. 7 and falling within zone C of FIG. 4. This fiber is characterized by having ends that have substantially square terminations similar to that in FIG. 11. For a given relative velocity the fiber lengths fall within a reproducible range becoming longer and approaching a straight filament as the relative velocity ratio increases.

Upon further increasing the relative coolant velocity zone D is reached producing fiber or filament as shown in FIG. 8. Continuity in this zone is easily maintained without the necessity of precise monitoring of filament forming conditions.

For conditions in zones D, E, and F the higher relative velocity of the coolant keeps the fiber straighter. Zone E provides conditions for making long but discontinuous fiber where both ends taper very slowly to a point over distances equivalent to several diameters as shown in FIG. 9. These conically tapered terminations, referred to as wet breaks, are depicted in FIG. 12. In zone F where the relative co-current coolant velocity is higher than zone E, even shorter fibers with reproducible lengths and wet break terminations are formed. The pointed, wet break terminations are fused vestiges of a symmetrical local necking flow phenomenon occuring whenever the accumulating tensile force reaches a specific value and accelerates the fiber away from the molten liquid zone.

The interaction between the moving filament stream and coolant in some of these zones initiates drag force disturbances. Under certain conditions these drag disturbances can propagate upstream to the weak, molten zone of the jet stream. This problem and corresponding force analysis has been disclosed in U.S. Pat. Nos. 3,720,741; 3,715,418; 3,715,419 and 3,658,979. In particular U.S. Pat. No. 3,720,741 discloses in FIG. 10 the relationship between the normalized vertical stream tension force $F_n$, as a function of the coolant velocity $V_g$. FIG. 10 of U.S. Pat. No. 3,720,741 is reproduced in FIG. 10 of the present specification with the coolant velocity $V_g$ represented by $V_c$ in this specification, $V_c$ being my nomenclature. FIG. 10 of the present invention has in addition to the curve shown in U.S. Pat. No. 3,720,741 a horizontal line intersecting the $F_n$ axis at a point $F_n$* to be defined later. The improvement and discovery of the present invention will be described in part with reference to this graph recognizing the fact that the mathematical relation for the graph in U.S. Pat. No. 3,720,741 is based on empirical data. It is noted that the solution to mechanical and thermal effects of a metal filament stream flowing through a cooling atmosphere has never been solved absolutely.

The prior art disclosed two regions, one where stable filament production occurs and the other where drag disturbances propagate upstream to the molten zone of the stream and interrupt jet stream continuity. The limit on coolant velocity as it varies with molten jet stream velocity is given by the curve designated $V_p$, with $V_p$ being defined in the art as the velocity of propagation of the stream disturbances (relative to the stream velocity $V_j$). Accordingly, the art has disclosed that stream disruptions due to propagation of these drag-sustained deviations towards the molten region occurs below and to the left of $V_p$ line, and does not occur above and to the right of this line. By this curve the art at best has implied that the transition between disruptive and stable jet flow occurs over a wide range of values.

For sake of clarity and consistency with the prior art disclosures, $V_j$ and $V_c$ are measured positive away from the orifice and $V_p$ is measured positive in the direction of the orifice. FIG. 10 of the present invention therefore discloses the relationship of the three velocities $V_p$, $V_c$ and $V_j$ as they relate to a method of making continuous metal filament. It is noted that U.S. Pat. No. 3,720,741 in its FIG. 10 described the $V_p$ line as defining the region between stable and disruptive conditions for producing continuous filament. This $V_p$ line is the condition at which $V_p = V_j$. When the value of $V_p$ is much greater than the value of $V_j$, then short lengths of metal fiber are produced. As $V_p$ decreases, increasingly longer fibers are produced. When $V_p$ becomes less than $V_j$ continuous filaments result within certain limits and under certain conditions specified in U.S. Pat. No. 3,720,741.

It has been found that continuous metal filament can be made from an enclosed melt pot having at least one orifice by the steps of: charging the melt pot with molten metal, pressurizing the contents of the melt pot to a pressure sufficient to cause a molten metal stream to flow from the orifice with a velocity $V_j$; flowing a mass of cooling fluid having a velocity $V_c$ coaxially around the molten metal stream such that the following relationship is maintained:

$$V_p \leq V_j$$

and $$F_n \leq F_n^*$$

$F_n$ is defined and described in U.S. Pat. No. 3,720,741, and is the normalized tensile force acting on the filament stream with $$F_n = [(F_g - F_d)/F_g]$$

where $F_g$ is the gravitational component acting on the filament stream and $F_d$ is the viscous drag force between the filament stream and the coolant atmosphere; and, allowing the stream to solidify. In essence, U.S. Pat. No. 3,720,741 discloses that for a given set of $V_c$ and $V_j$ values for a given filament stream (the diameter and material being specified) the values of $F_n$ can be obtained as in FIG. 10. $F_n$* is defined herein as the normalized tensile force at which fibers of length L begin to be formed by tensile separation, where L is the actual free drop length of the coolant column of the melt spinning equipment or defined as the distance between the bottom of the orifice plate 32 and the contact point 320 on the deflector plate 10.

A discovery of this invention is that filaments are formed only when the coolant and jet velocities are adjusted so that $F_n$ is less than $F_n$*, or $F_n < F_n$*, which means that conditions which cause tensile disruptive forces must also be suppressed if filaments defined in U.S. Pat. No. 3,720,741 are to become continuous. Correlatively, a second discovery of this invention is a method of forming fibers by appropriate adjustments of the two flow velocities such that $F_n < F_n$*. The advancement disclosed by the inventor is that the tensile disruptive process can be utilized to produce short fibers with reproducible lengths which are inversely proportional to $F_n$ in cases where $F_n < F_n$*.

For example, in FIG. 10 when a molten metal jet stream of a given diameter moving with a velocity $V_j$ is injected into a cooling atmosphere moving with a velocity $V_c = a$, and the velocity $V_c$ is increased in a step wise manner from point A on line $V_j$ (as indicated by points B, C, D, E, F and G) the conditions existing between the cooling gas and filament stream will proceed as shown. Points A, B and C in a region where mechanical disruptions induced in the filament stream travel upward toward the orifice and cause it to break at a weaker zone thereby forming short length fibers. Point D on the $V_j$ line, is above the $V_p$ line (defined in the art as the limit where jet stream disruptions can not propagate upstream because the jet is moving as fast away from the orifice as the wave front is moving towards the orifice). In this stable region continuous filaments are produced. What the art does not disclose is what happens at points E, F and G. According to prior art disclosures this appears to be a stable region where continuous filaments are possible for all relative coolant and jet stream velocities as long as they meet the stability criterion. It was found, however, that this is not the case. When the normalized tensional force $F_n$ exceeds $F_n$*, tensile forces act on the filament such that short length fibers are produced. Therefore, the discovery is that continuous filaments are only produced when $F_n$ is less then $F_n$* and $V_p \leq V_j$. It has been found that the region of continuous filament production is located in an envelop of values that lies above the $V_p$ line and below the $F_n$* line. This condition being indicated mathematically as:

$$V_p \leq V_j$$

and $$F_n < F_n^*$$

For another higher jet stream velocity $V_j$ , as shown in FIG. 10, where $V_j > V_j$, it is noted that the range of forming continuous filament is larger because the appropriate values for coolant velocity lie between $V_c$ and $V_c$ , which by observation is greater than the spread between $V_c$ and $V_c$ for the $V_j$ line. Alternately, for a lower jet stream velocity $V_j$ , where $V_j < V_j$, the corresponding range of coolant velocities, existing between $V_c$ and $V_c$ , for forming continuous filaments is smaller by observation than the range from $V_c$ to $V_c$ for the $V_j$ line. For one particular lower jet velocity such as illustrated by $V_j$ only one set of values for $V_c$ and $V_j$ can be utilized to form continuous filaments. At even lower jet velocity values, such as $V_j$ , there are no conditions where continuous filaments can be formed.

The present invention extends the ability to make filaments and fibers by introducing the coolant flow as an independent variable in the filament forming process. Thus unlike the prior art the invention teaches that correlated manipulation of both coolant and jet velocities can systematically vary the normalized tensional force, $F_n$, over an entire range of values. This relationship allows one skilled in the art to produce melt spun metal filaments or fibers of any desired length.

FIG. 10 of the present invention therefore discloses the velocities $V_p$, $V_c$ and $V_j$ within which a method of making continuous metal filament or discontinuous metal fiber can be produced. Whereas the locus of points where $V_p = V_j$ disclosed in the art is the lower limit defining the difference between continuous filament and non-continuous fiber, I have established that there is also an upper limit, $F_n$*, defining the difference between conditions for producing filament and fibers. Accordingly, the range of continuity must be defined as:

$$V_p \leq V_j \text{ and } F_n \leq F_n^*$$

It has been found that continuous metal filament can be cast, from a melt pot containing molten metal and having at least one orifice, by causing the molten metal to flow through the orifice with velocity $V_j$, and flowing a mass of cooling fluid (preferably a gas) having a velocity $V_c$, coaxially around the emerging metal jet such that, $V_p \leq V_j$ and the maximum normalized tensional force does not exceed the relation $F_n < F_n$* and allow the jet to solidify.

The inventor has discovered the appropriate velocity ranges for making filament that falls within the dynamic equilibrium region shown in FIG. 4. This equilibrium region is where the molten jet stream is injected into a coolant atmosphere under conditions where excessive stream acceleration and/or deceleration forces are not acting. Referring to FIG. 10, points A through E on line $V_j$ correspond to zones A through E of FIG. 4 and the type of fiber in general produced at these points and zones are respectively shown in FIGS. 5 through 9. The lower limit of the continuity region is represented by the drag disruptive curve $V_p = V_j$ and the upper limit is represented by the horizontal line $F_n$* defining the point where drag acceleration forces cause filament discontinuity by tensile separation. Tensile separation can be prevented by adjusting either the coolant flow or jet flow velocities such that $V_c < F_j$ or by shortening the free drop length L shown in FIG. 1 of the cooling chamber. Such settings are most readily attained by iterative adjustment of the operating parameters ($V_c$ and $V_j$) rather than by analytical models or calculations.

Viewing FIGS. 5 through 9 in conjunction with FIGS. 4 and 10, the shape of the product advances from disjoined, fragmented and welded short staple fiber, to short curly staple fiber, to long continuous filaments, to short straight staple fiber having conically tapered ends, to still shorter staple fiber having conically tapered ends. Changing the coolant velocity from stagnant to high co-current values clearly illustrates the transition from deceleration support region to dynamic equilibrium region to acceleration separation region.

Accordingly, the lines $V_p$ and $F_n$* in FIG. 10 and their location delineate the operating conditions for forming continuous and discontinuous filament in relative terms. For a specified combination of coolant, liquid metal, jet diameter and coolant column dimensions, the tensile forces and velocities are given in a normalized form. A change in any one chemical specie or geometrical dimension will cause the curves to shift in a systematic manner. Accordingly, a jet of fixed diameter of a given molten metal utilizing a specified coolant will have a specified set of curves for $V_p = V_j$ and $F_n$* and a different set of curves for other coolant fluids having different thermal characteristics. Correlatively, for a specified coolant fluid used in the melt spinning operation, a set of curves for $V_p = V_j$ and $F_n$* will be generated with changes in liquid metal properties and/or jet diameter. Whatever changes are desired the general form of the curves and the types of relationships necessary for making filaments or fibers will remain the same.

EXAMPLE I

Table I lists the data obtained when a 4.2 mil diameter product was melt spun from a molten charge of commercial purity Aluminum (type 1100) held at 680° C.

TABLE I

Experimental Parameters and Properties of 4.2 mil diameter Al fibers and filaments

| Velocity Ratio $V_c/V_j$ | Fiber Length (ft.) | Fiber Morphology | Type of Fiber Termination |
|---|---|---|---|
| 0.51 | 1½ – 2 | Curly | Square |
| 0.6 | 4 – 8 | Slightly Curly | Square |
| 0.69 | Continuous | Straight | — |
| 0.80 | Continuous | Straight | — |
| 0.88 | 10 – 20 | Straight | Wet |
| 0.98 | 5 – 6½ | Straight | Wet |
| 1.01 | 2 – 5 | Straight | Wet |
| 1.11 | 4 | Straight | Wet |
| 1.21 | 2 – 3 | Straight | Wet |

Using a melt pot overpressure of 40 psi the molten jet stream, with a nominal velocity ($V_j$) of 3000 fpm, was injected into a co-currently flowing ambient air coolant stream with the velocity ($V_c$) varied between 1500 and 3600 fpm. Under low coolant velocity conditions where $V_c/V_j = 0.51$ and 0.6, fiber curling occurred and upstream propagation of drag disruptive forces caused square breaks (FIG. 11). Using FIG. 10 for illustrative purposes and considering the velocity value for line $V_j$ to be 3000 fpm, the condition of $V_c/V_j = 0.51$ and 0.60 would correspond to points B and C respectively, which points fall in the deceleration support region shown in FIG. 4. When the co-current coolant velocity is increased so that $V_c/V_j = 0.69$ and 0.8 the product becomes a continuous, substantially straight filament. Point D in FIG. 10 would be representative of these two conditions. Continuous filaments result under these conditions since the flow conditions fall in the dynamic equilibrium range shown in FIG. 4. Increasing the coolant velocity so that $V_c/V_j = 0.88$ causes the flow condition to fall in the transition area between dynamic equilibrium and acceleration separation regions indicated by E in FIGS. 4 and 10. Here the ends of the jet stream separate at the molten zone, this defined as a "wet" fiber discontinuity or break This situation occurs when sufficient tensile forces build up to cause acceleration separations. The straight filaments are still long (lengths over 10 feet). All other conditions with higher coolant velocities produced straight discontinuous fibers having ends defined by wet breaks shown in FIG. 12. Here the combination of acceleration separation and gravitational forces generally produces regularly truncated fibers with the wet breaks in the form of conically tapered terminations. The corresponding fiber lengths for each coolant flow condition can be seen to decrease as the velocity ratio increases.

Example I shows that at a fixed jet velocity $V_j$, variations in the co-current coolant velocity $V_c$ will change the shape of the fiber or filament including its end points and will also systemically affect continuity as indicated in FIG. 4.

EXAMPLE II

In Table II the characteristics of melt spun zinc filaments and fibers with diameters of 3½ mils are listed.

TABLE II

Experimental Parameters and Properties of 3-½ mil diameter Zn Fibers and filaments

| Velocity Ratio $V_c/V_j$ | Fiber Length (ft.) | Fiber Morphology | Fiber End Termination |
|---|---|---|---|
| 0.83 | 7 – 9 | Straight | Square |
| 1.25 | 2½ – 3 | Straight | Wet |
| 1.66 | 1½ – 2 | Straight | Wet |
| 2.08 | ½ | Straight | Wet |

In this case commercial purity molten zinc was held in the melt pot at 505° to 510° C, and a molten zinc jet stream was forced through an orifice in the melt pot using a 50 psi overpressure. The resultant zinc jet stream with a nominal velocity of 1400 fpm was injected into a co-currently flowing air coolant stream with velocities that were varied between 1200 and 3000 fpm. Comparing the zinc and aluminum examples it appears that the zinc examples had characteristics that were equivalent to the aluminum examples at different relative velocity ratios. This shift is attributed to both a diameter effect as well as differences in physical (especially density) properties of the zinc charge. Nevertheless the trend in the acceleration separation region where fiber length decreases as the relative velocity ratio increases was again obvious.

Examples I and II show that the important factor controlling fiber continuity is the relative velocity ratio or mismatch between the molten jet stream and coolant velocities rather than the absolute value of either the jet and/or the coolant velocity. The existence of an optimum set of relative velocity conditions to make continuous filament as well as the capability of forming regularly truncated fiber segments by controlling the relative velocities of coolant with respect to jet, has been demonstrated and correspond the concepts shown in FIG. 4. As noted the position of the curves shown in FIG. 4 in turn are dependent on the material composition, diameter, and velocity of the emergent jet.

EXAMPLE III

A further example of the effect of velocity mismatch on continuity is given in Table III for a 4.9 mil diameter 1100 Aluminum jet injected at three different $V_j$ values into ambient air flowing at one of two constant velocity levels.

Table III

Experimental Parameters and Properties of a 4.9 mil diameter Al stream injected at various jet velocities into an air coolant stream of constant velocity.

| Velocity Ratio $V_c/V_j$ | Fiber Length (ft.) | Fiber Morphology | Fiber End Termination |
|---|---|---|---|
| for $V_c$ = 2400 fpm | | | |
| 1.03 | 2½ | Straight | Wet |
| 0.90 | 3 – 3½ | Straight | Wet |
| 0.84 | 3½ – 5 | Straight | Wet |
| for $V_c$ = 2100 fpm | | | |
| 0.89 | 3 – 3½ | Straight | Wet |
| 0.79 | 4½ – 5 | Straight | Wet |
| 0.74 | 4 – 6 | Straight | Wet |

Varying the melt pot pressure from 35 to 30 to 25 psi. results in decreasing the emerging molten jet stream velocity $V_j$ from 2850 to 2600 to 2360 fpm respectively. The length of the fiber for each of these velocities respectively were 3½ to 5 ft., 3 to 3½ ft. and 2½ ft. all having ends conically truncated. A second set of data for a slightly lower coolant velocity ($V_c$ = 2100 fpm) are also given in Table III.

EXAMPLE IV

In Table IV analogous results for smaller diameter (4.2 mil) Aluminum fiber are presented for three significantly different coolant velocities: $V_c$=3000, 2400, and 1800 fpm.

Table IV

Experimental parameters and properties of a 4.2 mil diameter Al stream injected at various jet velocities into air flowing at one of three constant velocity levels.

| Velocity Ratio $V_cV_j$ | Fiber Length (ft.) | Fiber Morphology | Fiber End Termination |
|---|---|---|---|
| For $V_c$ = 3000 fpm | | | |
| 0.74 | continuous | straight | — |
| 0.84 | continuous | straight | — |
| 0.91 | continuous (20) | straight | — |
| 0.98 | 5 – 6 ½ | straight | wet |
| 1.01 | 2 – 5 | straight | wet |
| 1.09 | 3 – 3½ | straight | wet |
| 1.18 | 2½ – 3 | straight | wet |
| 1.41 | ½ – 1½ | straight | wet |
| For $V_c$ = 2400 fpm | | | |
| 0.59 | continuous (20) | slightly curly | square |
| 0.67 | continuous (32) | straight | — |
| 0.77 | continuous | straight | — |
| 0.82 | continuous | straight | — |
| 0.87 | 5½ – 6½ | straight | wet |
| 0.95 | 6 | straight | wet |
| 1.13 | 1½ – 3 | straight | wet |
| For $V_c$ = 1800 fpm | | | |
| 0.5 | 3 | curly | square |
| 0.55 | 1½ – 3½ | curly | square |
| 0.59 | continuous(32) | slightly curly | — |
| 0.65 | continuous | straight | — |

Table IV-continued

Experimental parameters and properties of a 4.2 mil diameter Al stream injected at various jet velocities into air flowing at one of three constant velocity levels.

| Velocity Ratio $V_cV_j$ | Fiber Length (ft.) | Fiber Morphology | Fiber End Termination |
|---|---|---|---|
| 0.71 | 5 – 11 | straght | wet |
| 0.85 | 2½ – 5 | straight | wet |

For each series with coolant velocity $V_c$ being held constant, the melt pot overpressure was varied from 20 to 50 psi so that the corresponding jet velocities $V_j$ ranged from 2100 to 4100 fpm. In this example the larger increments (±25%) between coolant velocities produced three distinct curves on the fiber length versus relative velocity plots typified by FIG. 4. The peak maximum position and the tensile separation branch of the curve shifting to respectively higher values of the relative velocity ratio for each series with higher $V_c$ values. This trend indicates that the aerodynamic drag forces influence the length of the truncated fiber, with the trend to shorter fibers as the velocity mismatch ($V_c - V_j$) becomes more positive. Since the velocity mismatch value may be negative for the conditions that optimize filament continuity, it follows that shorter fibers are produced as this term becomes less negative.

Comparing the data from Examples III and IV, where the composition of the jet was held constant, it appears that the position of the peak maximum and tensile separation branch of the length versus relative velocity plot both shift toward higher $V_c/V_j$ values for the smaller diameters. Accordingly, to form larger diameters it will require conditions of greater negative velocity mismatch than for the smaller diameter with a comparable length.

Since continuous metal filaments are generally formed at $V_c/V_j$ values less than unity, the relatively slower moving coolant stream will partially support the jet stream by means of an upstream directed drag deceleration type force opposite to the gravitational force reducing the effective force on the fiber to less than the gravitational tensile force. The flowing coolant allows the fiber or filament to move away from the orifice without exciting drag disruptive forces which would terminate jet continuity with the characteristic square break.

It is noted that the trend, indicating that velocity mismatch controls continuity, holds for all fiber diameters and melt material being spun. Although the examples disclose using either an aluminum or zinc melt, the process holds true for other metals including lead, aluminum, stainless steel, zinc, etc.

It can now be appreciated that there has been herewith disclosed a unique set of velocity relationships, the practice of which will enable one skilled in the art to obtain the production of various shaped, continuous length filaments and discontinuous fiber from low viscosity melts. By employing the present teachings, one is able to place the free stream process into a condition of producing any desired length of filament by varying the velocity mismatch between the jet stream and coolant fluid. Once an empirical determination for $V_p$ and $F_n$* for a specific melt, cooling fluid and spinning equipment is made, following the presently disclosed velocity relationships will produce any length of continuous filament or discontinuous fiber desired.

While the foregoing description sets forth the principles of the invention many obvious variations, modifications and substitutions may be made by those skilled in the art, with the terms and expressions employed being terms of description in the art, and not of limitation, with no intention in using such terms to exclude any equivalent of the structures described. It is understood then that the description of the invention is made only by way of example and that there exists many alternative process manipulations, and that the invention is limited only by proper construction of the accompanying claims.

What I claim is:

1. A method of making substantially straight metal fibers from an enclosed melt pot having at least one orifice, comprising the steps of:

a. charging the melt pot with molten metal;

b. pressurizing the contents of the melt pot to a pressure sufficient to cause a molten metal stream to flow from the orifice with a velocity $V_j$;

c. flowing a mass of cooling gas having a velocity, $V_c$, coaxially around the molten metal stream as it exits the orifice said cooling gas flowing co-currently around the molten stream substantially past the point where the stream is solidified, $V_c$ measured positive in the direction away from the orifice; and d. adjusting the velocity $V_c$ of the cooling gas to achieve $$V_p < V_j$$

and $$F_n > F_n^*$$

wherein $V_p$ is the propagation velocity of the drag sustained deviations as measured positive in the direction toward the orifice, $F_n$ is the normalized tensile force defined by $(F_g - F_d)/F_g$ where $F_g$ is the gravitational force acting on the filament of length 1 and $F_d$ is the drag force developed by friction of the cooling fluid with the surface of the filament stream, and $F_n^*$ is the normalized tensile force that would cause fibers of length L to be formed by tensile separation.

2. A method of making substantially straight metal fibers from an enclosed melt pot having at least one orifice, comprising the steps of:

a. charging the melt pot with molten metal;

b. pressurizing the contents of the melt pot to a pressure sufficient to cause a molten metal stream to flow from the orifice with a velocity $V_j$;

c. flowing a mass of cooling gas having a velocity, $V_c$, coaxially around the molten metal stream as it exits the orifice said cooling gas flowing co-currently around the molten stream substantially past the point where the stream is solidified, $V_c$ measured positive in the direction away from the orifice; and d. adjusting the velocity $V_j$ of the metal stream to achieve $$V_p < V_j$$

and $$F_n > F_n^*$$

wherein $V_p$ is the propagation velocity of the drag sustained deviations as measured positive in the direction toward the orifice, $F_n$ is the normalized tensile force defined by $(F_g - F_d)/F_g$ where $F_g$ is the gravitational force acting on the filament stream of length 1 and $F_d$ is the drag force developed by friction of the cooling gas with the surface of the filament stream, and $F_n^*$ is the normalized tensile force that would cause fibers of length L to be formed by tensile separation.

3. In a machine combination for making metal fibers from a heated melt pot having at least one orifice, the pot charged with a molten metal and pressurized with an inert gas to cause a molten metal stream to flow from the orifice with a velocity $V_j$, the improvement comprising:

a. means for flowing a mass of cooling gas having a velocity $V_c$, coaxially around the molten metal stream as it exits the orifice said cooling gas flowing co-currently around the molten stream substantially past the point where the stream is solidified, fresh cooling fluid always surrounding the molten stream;

b. means for adjusting the velocity $V_j$ of the molten stream and the velocity $V_c$ of the cooling stream to provide:

$$V_p < V_j$$

and $$F_n > F_n^*$$

wherein $V_p$ is the propagation velocity of the drag sustained deviations as measured positive in the direction toward the orifice, $F_n$ is the normalized tensile force defined by $(F_g - F_d)/F_g$ where $F_g$ is the gravitational force acting on the filament stream of length 1 and $F_d$ is the drag force developed by friction of the cooling fluid with the surface of the filament stream, and $F_n^*$ is the normalized tensile force that causes fibers of length L to be formed by tensile separation; and c. means for having the cooling portion of the machine combination open to the atmosphere.

* * * * *